US005233796A

United States Patent [19]

Mazalewski, Jr.

[11] Patent Number: 5,233,796

[45] Date of Patent: Aug. 10, 1993

[54] MOBILE CONTAINERIZED SANDBLASTING MULTI-UNIT

[76] Inventor: Robert J. Mazalewski, Jr., 9 Lakeridge Ave., Sandown, N.H. 03873

[21] Appl. No.: 988,798

[22] Filed: Dec. 10, 1992

[51] Int. Cl.[5] ..... B24B 1/00

[52] U.S. Cl. ..... 51/426; 51/427; 51/429; 134/84

[58] Field of Search ..... 51/426, 427, 429, 424, 51/425; 134/84

[56] References Cited

U.S. PATENT DOCUMENTS

| | | | |
|---|---|---|---|
| 2,696,910 | 12/1954 | Ljungdell | 51/425 |
| 3,399,492 | 9/1968 | Crowe | 51/429 |
| 3,559,343 | 2/1971 | Foster | 51/410 |
| 4,562,791 | 1/1986 | Porter | 51/429 |
| 4,787,179 | 11/1988 | Lewis | 51/429 |
| 4,800,063 | 1/1989 | Mierswa | 51/425 |

*Primary Examiner*—Bruce M. Kisliuk
*Assistant Examiner*—Jack Lavinder
*Attorney, Agent, or Firm*—Edward A. Gordon

[57] ABSTRACT

The present invention provides a new and improved sandblasting mobile decontamination multi-unit to properly and safely remove lead-based paint from various surfaces of materials to thereby minimize the amounts and quantities of hazardous materials. The mobile containerized sandblasting multi-unit of the present invention includes a forward cab and a rearward multi-unit body. The multi-unit body includes a forward chamber unit to conduct sandblasting by at least one operator. A sandblast means is mounted in the forward chamber unit section to provide a sandblasting process. Attached to the front wall of the forward chamber unit is a dust collector section. The forward chamber unit includes at least one exhaust and air filtration device attached to the front wall of the forward chamber unit section and to communicate with the dust collector section and which also includes providing exhausting and filtering of air used in the sandblasting process and preventing air pressure increase within the forward chamber unit. The multi-unit body includes a rearward section comprising a first rearward chamber unit section and a second rearward chamber unit section. The first rearward chamber unit section includes a decontamination section for final washdown of the selected sandblasted material positioned within the decontamination section. The second rearward chamber unit includes a first personal change compartment, a personal shower compartment, and a second personal change compartment.

11 Claims, 5 Drawing Sheets

MOBILE CONTAINERIZED SANDBLASTING MULTI-UNIT

BACKGROUND OF THE INVENTION

1. Field Of The Invention

The present invention relates generally to a sandblast room and more particularly to a new and improved sandblasting mobile decontamination multi-unit to properly and safely remove lead-based paint from various surfaces of materials.

2. Description Of Prior Art

There are numerous devices in the prior art for abrasive blasting. In U.S. Pat. No. 3,559,343, there is disclosed a sandblast truck including an enclosed truck body, an engine-driven compressor mounted crosswise within the truck body, a sandblast unit mounted within the truck body, a partition dividing the truck body into a first compartment for containing the compressor and a second compartment for containing the sandblast unit, the partition being removable in the event access is required to the side of the compressor, and doors in the side of the truck body for selectively permitting the compressor to be exposed to the air for cooling and air-intake purposes. In one embodiment a hopper is fixedly mounted on the floor of the second compartment for feeding a sandblast unit which extends downwardly through the floor of the truck.

U.S. Pat. No. 2,741,878 discloses a self-contained mobile pipe cleaning apparatus comprising in combination a movable trailer type vehicle having a highly elongated load supporting portion including an elongated load supporting bed, a plurality of supporting wheels positioned at the sides of the bed adjacent the rearward end thereof and having axes of rotation above the level of said bed, an abrasive blast plant comprising a blasting cabinet and an elongated normally vertically disposed elevating mechanism for carrying abrasive material from the lower to the upper end of the cabinet. The blasting cabinet and elevator mechanism are positioned on the bed substantially between the wheels, the elevating mechanism being positioned adjacent to and immediately forward of the blasting cabinet.

U.S. Pat. No. 4,562,791 discloses a containerized movable maintenance plant grouping all equipment and facilities necessary to conduct abrasive blasting and thermal spraying operations for surface hardening and corrosion control of molten material.

U.S. Pat. No. 3,863,392 discloses a sandblast room having a grid-like floor through which abrasive material resulting from sandblasting operations may fall. A series of parallel adjacent channels extends beneath the grid-like floor to receive the abrasive material. A suction duct is connected to one end of each channel and a closure plate is disposed at the upper portion of each channel and movable between open and closed positions. When a given closure plate is closed the suction is horizontal through the associated channel and clears the same of abrasive material. When a closure plate is open the suction draws air downwardly through the blast room and the grid floor and into the channel to clear the air in the blast room.

The state of the art is also believed to be exemplified by the following U.S. Pat. Nos.: 2,869,291 and 4,787,179.

These prior art devices are not exhaustive, they are believed to be exemplary of the state of the art. While such prior art devices provide improvement in the areas intended, there still exists a need for a new and improved sandblasting mobile decontamination multi-unit to properly and safely remove hazardous material such as lead-based paint from the surfaces of various materials.

Accordingly, a principle desirable object of the present invention is to provide a new and improved mobile containerized sandblasting multi-unit to remove lead-based paint from the surfaces of various materials.

Another desirable object of the present invention is to provide a new and improved sandblast truck decontamination unit.

Another desirable object of the present invention is to provide a new and improved sandblast portable trailer decontamination unit.

A still further desirable object of the present invention is to provide a sandblast lead-based paint decontamination unit containing a forward chamber section unit for sandblasting materials to remove lead-based paint, and the rear section forming two chamber sections, one being a material transfer chamber unit, and the other being a workers personal decontamination unit.

These and other desirable objects of the invention will in part appear hereinafter and will in part become apparent after consideration of the specification with reference to the accompanying drawings and the claims.

SUMMARY OF THE INVENTION

The present invention provides a new and improved sandblasting mobile decontamination multi-unit to properly and safely remove lead-based paint from various surfaces of materials to thereby minimize the amounts and quantities of hazardous materials. The mobile containerized sandblasting multi-unit of the present invention includes a forward cab and a rearward multi-unit body. The multi-unit body includes front and rear walls, side walls, a floor and a roof. The multi-unit body includes a forward chamber unit to conduct sandblasting by at least one operator. The forward chamber unit is defined by the front wall, equal portions of the side walls and a rear petition wall attached between the side walls. A sandblast means is mounted in the forward chamber unit section to provide a sandblasting process. Attached to the front wall of the forward chamber unit is a dust collector section. In the preferred embodiment, the forward chamber unit includes at least one exhaust and air filtration means attached to the front wall of the forward chamber unit section and to communicate with the dust collector section and which also includes providing exhausting and filtering of air used in the sandblasting process and preventing air pressure increase within the forward chamber unit. The multi-unit body includes a rearward section comprising a first rearward chamber unit section adjacent to a portion of the rear wall of the forward chamber unit section and a second rearward chamber unit section adjacent to the remaining portion of the rear wall of the forward chamber unit section. The first rearward chamber unit includes a decontamination section for selected sandblasted material and means for final washdown of the selected material positioned within the decontamination section. The second rearward chamber unit includes a first personal change compartment, a personal shower compartment, and a second personal change compartment.

DETAILED DESCRIPTION OF PREFERRED EMBODIMENT(S)

Figure 1:
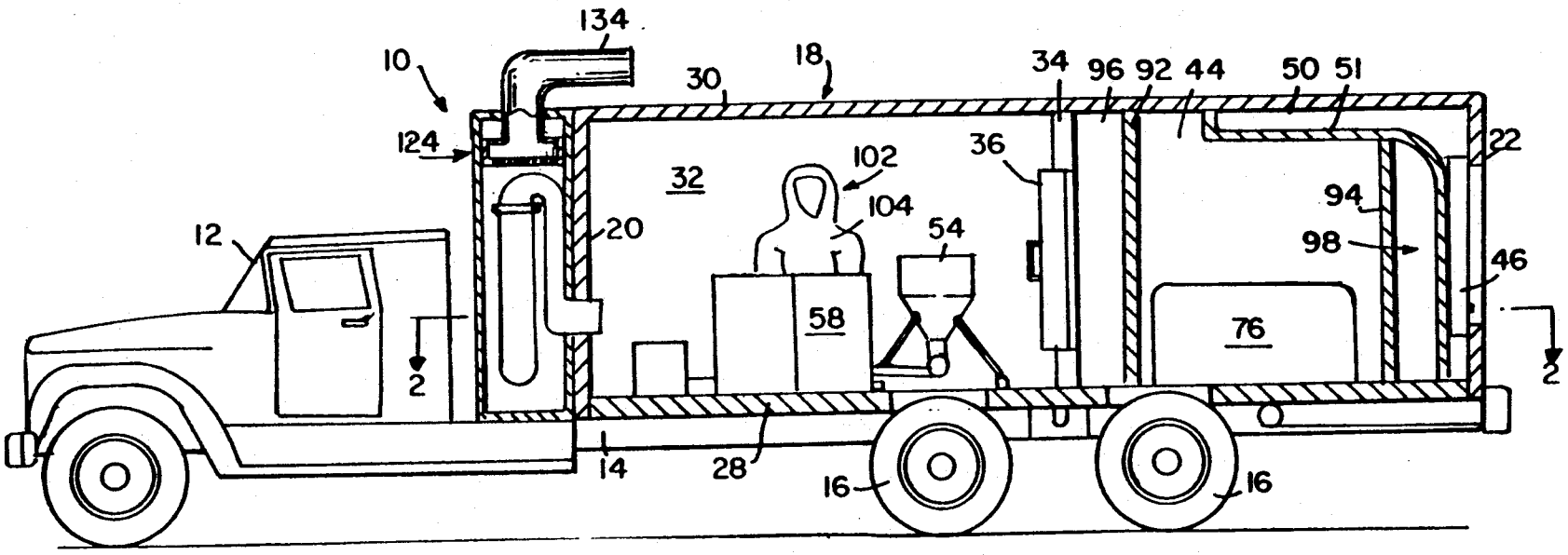
FIG. 1 is a side plan view partially in cross-section illustrating one embodiment of the mobile containerized sandblasting multi-unit device of the present invention.

Referring now to the drawings and more particularly to FIGS. 1-5, 7 and 8, there is illustrated the new and improved sandblasting mobile decontamination multi-unit device indicated generally by the reference numeral 10 embodying the principles of the present invention and hereinafter sometimes referred to as the mobile decontamination device 10. The mobile decontamination device 10 comprises a truck having a cab 12 attached permanently to the frame 14 with wheels 16. A self-contained decontamination multi-unit device 18 is mounted permanently on the frame 14. The multi-unit chamber device 18 includes a front wall 20, a rear wall 22, side walls 24 and 26, a floor 28 and a roof 30. In the preferred embodiment the walls 20, 22, 24 and 26 and the floor 28 and roof 30 are formed of solid steel or covered with solid steel.

The sandblast unit 32 is formed and defined by the inner wall 34 which extends across and is attached to the side walls 24 and 26 and which is also preferably of solid steel and contains two steel doors 36 and 38.

The rear area of the multi-unit device 18 is divided into two rearward decontamination units 40 and 42 by wall 44 which extends from the inner wall 34 to the rear wall 22 and is also preferably formed of solid steel.

The rear wall 22 is provided with two rear doors 46 and 48. In the preferred embodiment the rear doors 46 and 48 are constructed and arranged to open and close by rolling up into the receiving area 50 by handles 52 and rolling down for closing. The receiving area 50 is formed by the upper roof section 30 and the lower support section 51.

The forward unit 32 is the chamber for conducting sandblasting of selected materials such as, for example, removing lead-base paint from various materials. The chamber unit 32 includes sandblasting equipment which includes a sandblast unit 54 mounted on wheels 56 and communicated with the compressor 58 by conduit 60. The diesel fuel tank 62 with an outer filler pipe and cap 63 for filling supplies the fuel requirement by conduit 64 to the engine illustrated generally at 66 which drives the compressor 58. The blasting medium of the sandblast generator device 54 is propelled through the flexible line 68 to a blasting gun 70.

Figure 3:
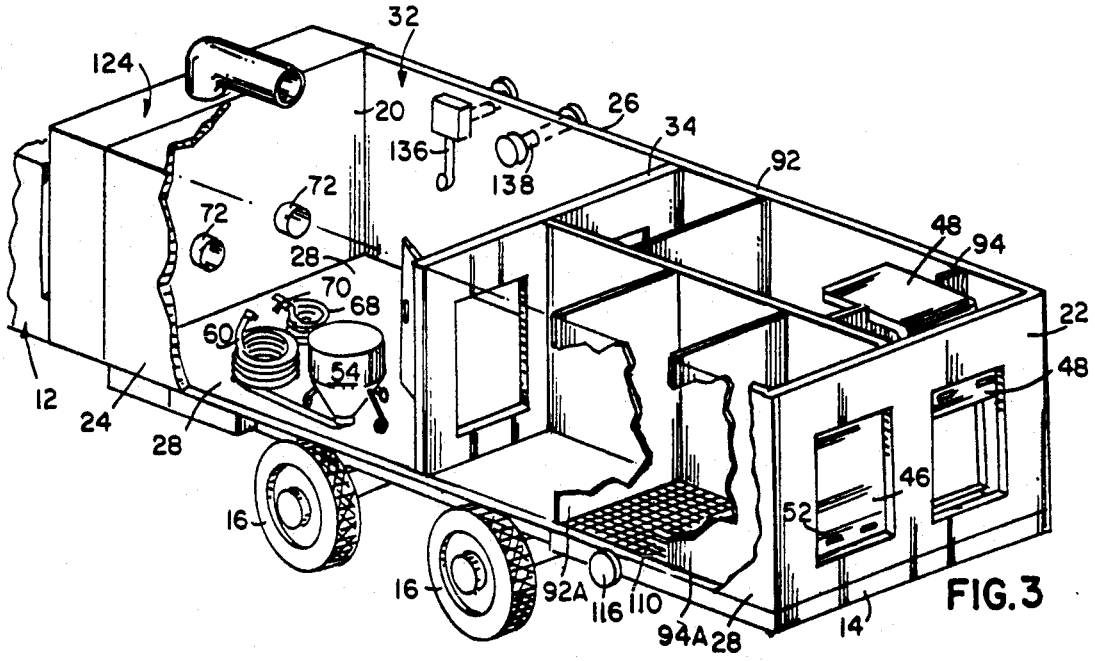
FIG. 3 is a fragmentary perspective view of the mobile sandblasting multi-unit device of the present invention.
Figure 4:
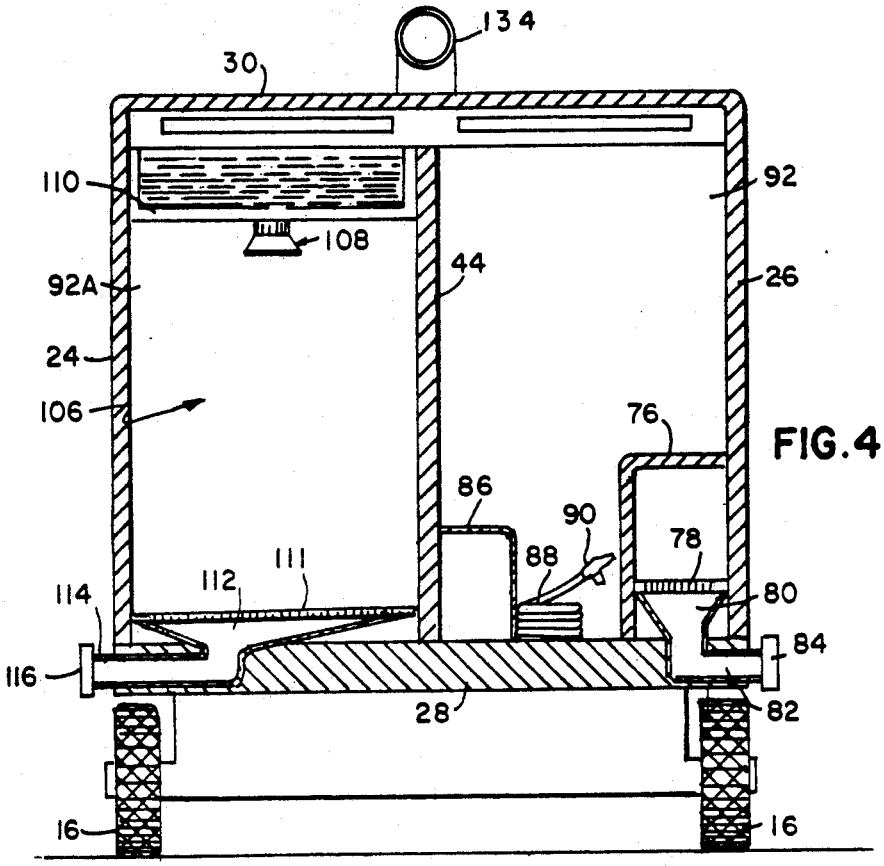
FIG. 4 is a cross-sectional view taken along the line 4—4 of FIG. 2.
Figure 5:
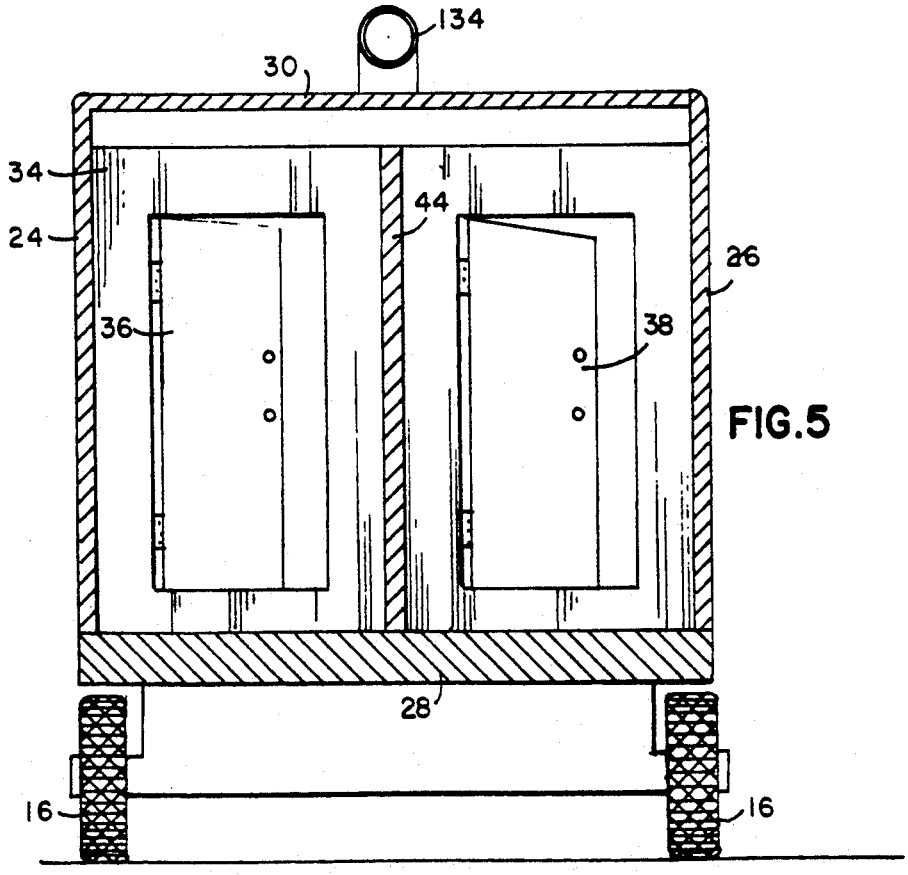
FIG. 5 is a cross-sectional view taken along the line 5—5 of FIG. 2;.

As illustrated in the alternate embodiment of FIG. 3, the sandblast unit 54 is communicated with an outside conventional air compressor and electrical conductor source (not shown) by contacting the sandblast unit 54 to the electrical conductor connector 136 and the compressed air inlet connector 138 each attached to the side wall 26 of the sandblast unit 32.

The sandblast unit 32 is provided with air dust removal devices 72 which are attached to the front wall 20. While two air dust removal devices 72 are described, it is to be understood that one or more than two can be used.

Figure 7:
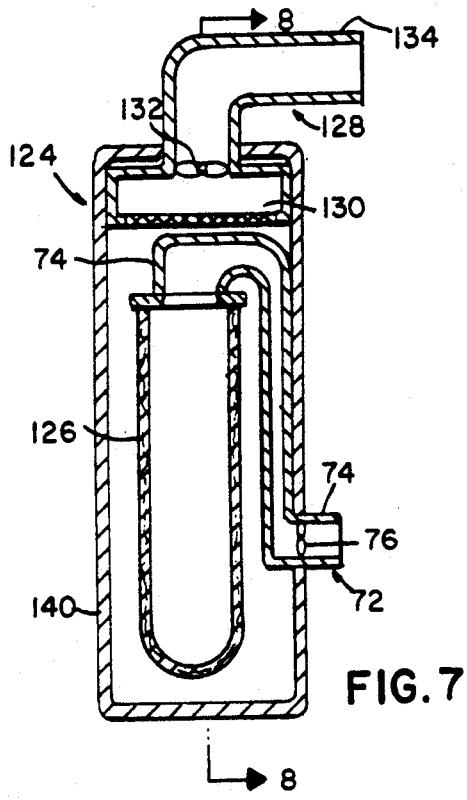
FIG. 7 is an enlarged side cross-sectional view of the dust collector section illustrated in FIGS. 1 and 6.
Figure 8:
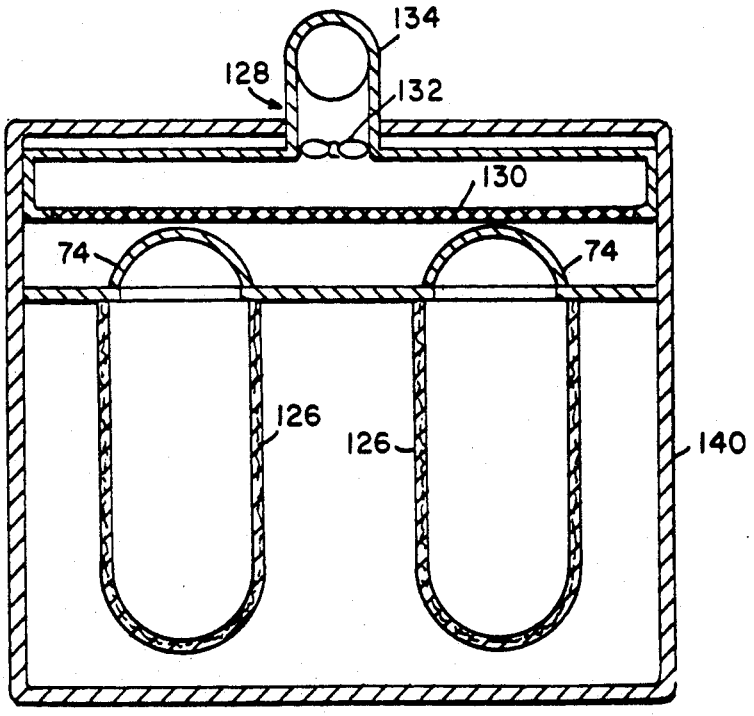
FIG. 8 is a cross-sectional view taken along the line 8—8 of FIG. 7.

Referring now also to FIGS. 7 and 8, the air dust removal devices 72 include a channel 74 which extends into the dust filtration device section 124, which is preferably formed by a solid steel wall 140 and is attached to the front wall 20, and an air fan device 76. The channels 74 extend into the bag means 126. The dust filtration device section 124 includes a second stage filtration means illustrated generally by the numeral 128. The filtration means 128 includes an air filtration means 130 such as a HEPA (high efficiency particulate air) mesh filter which provides filtration of 99.99% of dust when the fan 132 is operating whereby the safe filtered air is blown to the outer area through the channel pipe section 134. In this manner any fine dust which passes out of the bags 126 is prevented from passing out through the channel pipe section 134. The air filter means 72 and 130 will exhaust and filter air being used in the blasting process and also prevents air pressure to build-up in the sandblast unit 32 while the sandblaster device is operating.

The decontamination unit 42 is provided with entry door 38. The decontamination unit 42 includes a cleaning chamber 76 attached to the side wall 76 and having a porous bottom section 78 and a chamber 80 with a pipe 82 and cap 84 extending outside of the side wall 26. In one embodiment the material that is sandblasted in the sandblast unit 32 can be cleaned manually in the cleaning chamber 76. In another embodiment the cleaning chamber 76 includes a compressor container 86 and a flexible line 88 and a blasting gun 90. In this manner when a material is sandblasted in the sandblast unit 32 and cleaned of lead-based paint, the material is brought into decontamination unit 42 and placed into the cleaning chamber 76. The material is then washed down manually as stated or with the blasting gun 90 to remove any lead dust, for example, on the material. In the preferred embodiment the washing material used manually or contained in the compression container 86 is tri sodium phosphate (TSP) to use to clean the sandblasted material and remove the lead dust as mentioned. The sandblasted material can then be removed from the mobile decontamination multi-unit device 10. The decontamination unit 42 includes air lock devices 92 and 94 which are formed, for example, of polyethylene sheeting which forms chamber 96 formed between the wall 34 and door 38 on one side and the air lock device 92 and chamber 98 formed between the air lock device 94 and the wall 22 and door 48 on the other side. The air lock devices 92 and 94 are releasably attached to the inner surface of the roof 30 and are sufficiently flexible whereby the operator can raise them up to enter and exit. The air lock devices 92 and 94 serve to prevent any lead dust material, for example, from contacting the doors and walls forming the decontamination unit 42.

Figure 2:
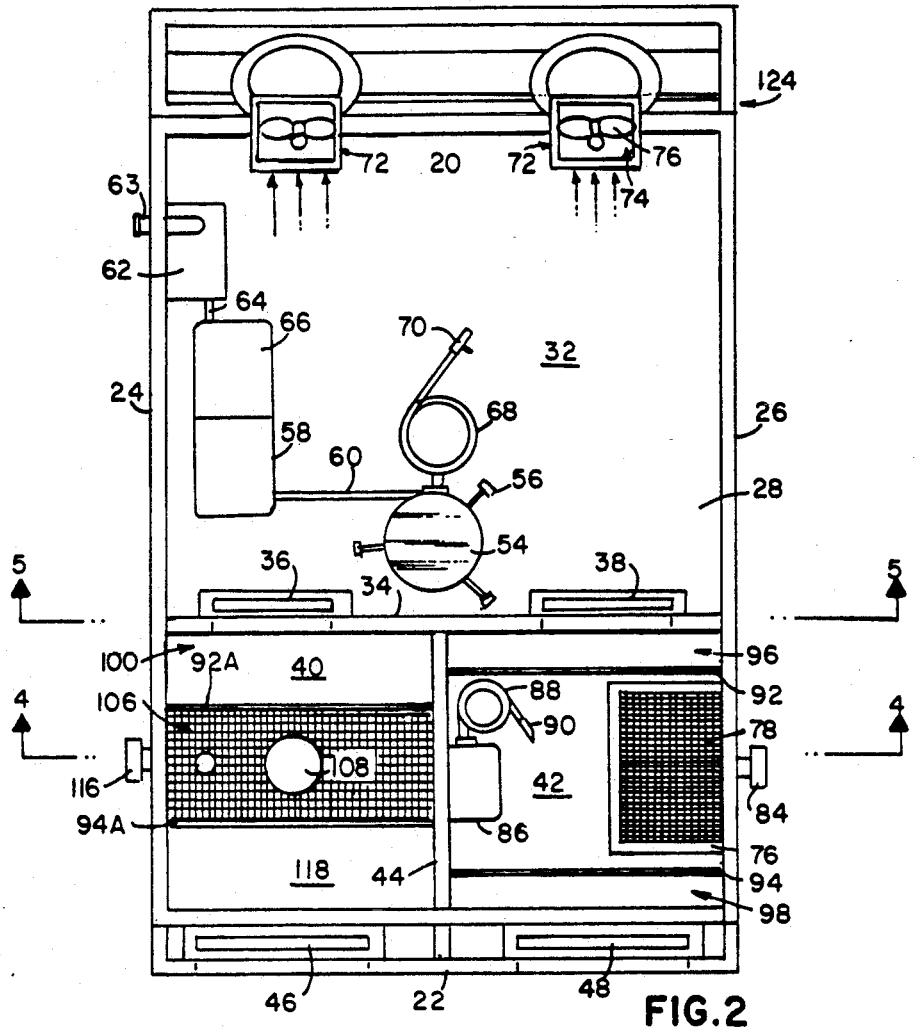
FIG. 2 is a cross-sectional view taken along the line 2—2 of FIG. 1 with the operator 102 omitted.

The decontamination unit 40 is provided with entry door 36. The decontamination unit 40 includes air lock devices 92A and 94A similar to the air lock devices 92 and 94 in unit 42. The decontamination unit 40 includes a chamber section 100 between the wall 34 and door 36 forming one side and the air lock device 92A forming the opposite side. The chamber section 100 provides a first personal change compartment for the operator 102 as shown in FIGS. 1 and 2 to remove the protective operating suit 104. The air lock devices 92A and 94A form a personal shower bath compartment 106 in which a shower device 108 with water container 110 is attached to the inner side of the roof 30. The compartment 106 includes a porous bottom floor 111 through which the shower bath water from water container 110 passes and is received by the chamber 112 which includes a pipe section 114 and a cap 116 extending outside of the side wall 24. In this manner the used shower water can be removed from the outside of the shower chamber 106 and filtered down, for example, to five microns before discharge. The chamber section 118 between the air lock device 94A on one side and the rear wall 22 and the door 46 on the opposite side defines a personal change compartment for the operators. The operator then leaves by door 46.

Figure 6:
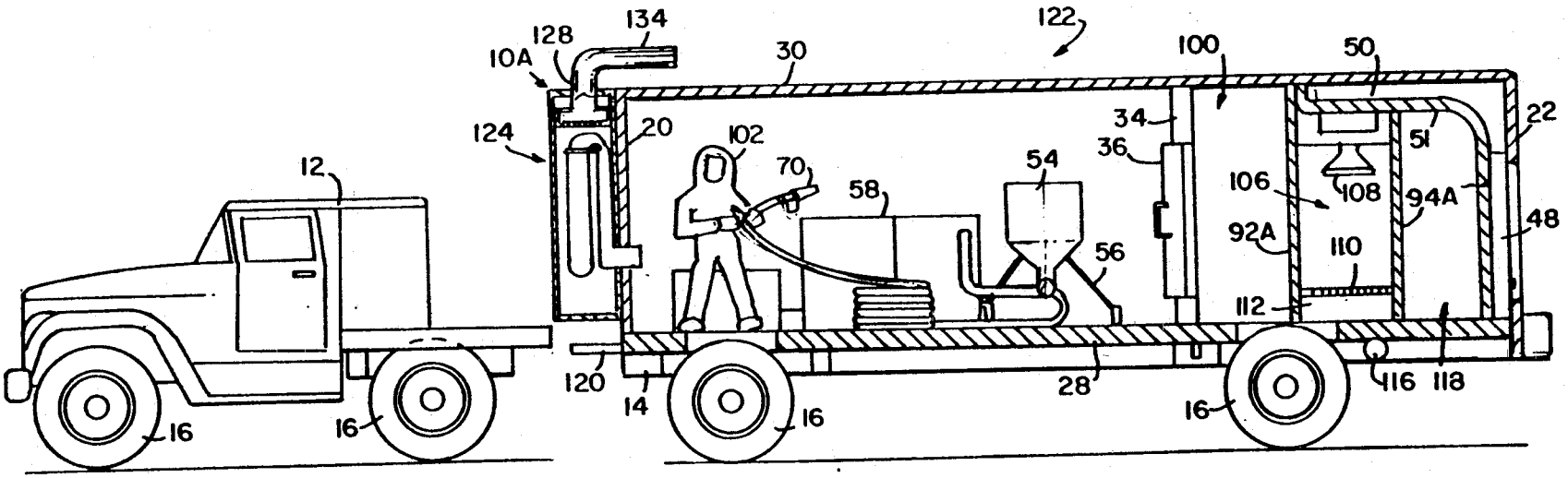
FIG. 6 is a side plan view partially in cross-section illustrating an alternate embodiment of the mobile containerized sandblasting multi-unit device of the present invention.

Referring now to FIG. 6, there is illustrated a sandblasting mobile decontamination multi-unit 10A which is similar to multi-unit 10 but is arranged to be a temporary stationary unit in which the cab 12 is releasably attachable to the frame sections 120 whereby the multi-unit device 122 is a portable trailer which can be left as a temporary stationary sandblasting multi-unit. The multi-unit device 122 is similar to the multi-unit device 18 and is illustrated as a larger embodiment.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A self-contained mobile decontamination multi-unit device comprising:

a forward cab and a rearward multi-unit body;

said multi-unit body having front and rear walls, side walls, a floor and a roof, said multi-unit body including;

a forward chamber unit for sandblasting selected materials defined by the front wall, equal portions of the side walls, and a rear partition wall attached between the side walls;

said forward chamber unit including means for sandblasting said selected material by at least one operator;

a wall means between the side walls and extending from the partition wall rearward to the rear wall of the multi-unit body;

a first rearward chamber unit is formed on one side of said partition wall;

a second rearward chamber unit formed on the other side of said partition wall;

said first rearward chamber unit including means for final washdown of said selected material by the operator; and said second rearward chamber unit including decontamination means for operators.

2. A self-contained mobile decontamination multi-unit device according to claim 1 wherein the forward chamber unit includes exhaust and air filtration means attached to the front wall of said forward chamber unit to provide exhausting and filtering of air used in the sandblasting process to thereby also prevent air pressure increase within said forward chamber unit.

3. A self-contained mobile decontamination multi-unit device according to claim 2 wherein the exhaust and air filtration means includes a high efficiency particulate air filtered dust collector device.

4. A self-contained mobile decontamination multi-unit device according to claim 1 wherein said first rearward chamber unit includes a decontamination section for the sandblasted selected material; and means for final washdown of said selected material positioned within said decontamination section.

5. A self-contained mobile decontamination multi-unit device according to claim 4 including flexible air lock devices positioned on each side of the decontamination section to thereby releasably enclose said decontamination section within said first rearward chamber unit.

6. A self-contained mobile decontamination multi-unit device according to claim 1 wherein said second rearward chamber unit includes a first personal change section; a personal shower section; and a second personal change section.

7. A self-contained mobile decontamination multi-unit device according to claim 6 including flexible air lock devices positioned on each side of the personal shower section to thereby releasably enclose said shower section within the second rearward chamber unit.

8. A self-contained mobile decontamination multi-unit device according to claim 1 wherein the forward cab is detachable from the rearward multi-unit body.

9. A self-contained mobile decontamination multi-unit device according to claim 1 wherein the chamber units include door means for operators to selectively enter and exit the chamber units and the multi-unit device.

10. A mobile decontamination multi-unit device comprising:

a forward cab and a rearward multi-unit body;

said multi-unit body having front and rear walls, side walls, a floor and a roof, said multi-unit body including;

a forward chamber unit for sandblasting selected materials;

a sandblast means mounted in said forward chamber unit to provide a sandblasting process;

exhaust and air filtration means attached to the front wall of said forward chamber unit to provide exhausting and filtering of air used in the sandblasting process to thereby prevent air pressure increase within said forward chamber unit; and a rearward section comprising a first rearward chamber unit attached to a portion of the rear wall of the forward chamber section and a second rearward chamber unit attached to the remaining portion of the rear wall of the forward chamber section;

said first rearward chamber unit including a decontamination section for said selected material, and means for final washdown of said selected material positioned within said decontamination section;

said second rearward chamber unit including a personal change section, a personal shower section, and a second personal change section.

11. A mobile decontamination multi-unit device comprising:

a forward cab and a rearward multi-unit body;

said multi-unit body having front and rear walls, side walls, a floor and a roof, said multi-unit body including;

a forward chamber unit for sandblasting selected materials;

a forward compartment section attached to the front wall of said forward chamber unit including exhaust and air filtration means to provide exhausting and filtering of air used in the sandblasting process and prevent air pressure increase within said forward chamber unit;

a first rearward chamber unit formed to a portion of the rear wall of the forward chamber unit said first rearward chamber unit including a decontamination section for said selected material, means for final washdown of said selected material positioned within said decontamination section and flexible air lock devices positioned on each side of the decontamination section; and a second rearward chamber unit formed to the remaining portion of the rear wall of the forward chamber unit, said second rearward chamber unit including a first personal change section adjacent the forward chamber unit, a personal shower section, and a second personal change section adjacent the rear wall of the multi-unit body, and flexible air lock devices positioned on each side of the personal shower section.

* * * * *